US007975328B2

(12) United States Patent
Lock et al.

(10) Patent No.: US 7,975,328 B2
(45) Date of Patent: Jul. 12, 2011

(54) UPWARD DISCHARGE WASTE DEVICE FOR A SHOWER TRAY

(75) Inventors: Graham Robin Lock, Isle of Man (GB); Robert William Stimpson, Isle of Man (GB); James Edward Self, Isle of Man (GB)

(73) Assignee: DLP Limited, Isle of Man, British Isles (GB)

( * ) Notice: Subject to any disclaimer, the term of this patent is extended or adjusted under 35 U.S.C. 154(b) by 1132 days.

(21) Appl. No.: 11/688,896

(22) Filed: Mar. 21, 2007

(65) Prior Publication Data

US 2008/0028514 A1 Feb. 7, 2008

(30) Foreign Application Priority Data

Aug. 2, 2006 (GB) ..... 0615297.9

(51) Int. Cl.
*A47K 3/00* (2006.01)

(52) U.S. Cl. ..... 4/613; 4/671

(58) Field of Classification Search ..... 4/603, 613, 4/671

See application file for complete search history.

(56) References Cited

U.S. PATENT DOCUMENTS

| | | | | |
|---|---|---|---|---|
| 4,975,992 | A * | 12/1990 | Patterson et al. | 4/599 |
| 5,357,639 | A | 10/1994 | Zellner | |
| D360,023 | S | 7/1995 | Hunger et al. | |
| 5,507,413 | A | 4/1996 | Chen | |
| 6,170,095 | B1 * | 1/2001 | Zars | 4/507 |
| 7,225,480 | B2 * | 6/2007 | Mascheroni | 4/613 |
| D572,347 | S | 7/2008 | Self et al. | |
| 2005/0172395 | A1 | 8/2005 | Helmetsie et al. | |
| 2008/0028514 | A1 | 2/2008 | Lock et al. | |

FOREIGN PATENT DOCUMENTS

| | | |
|---|---|---|
| GB | 2276541 | 10/1994 |
| GB | 2315211 | 1/1998 |
| GB | 2359484 | 8/2001 |
| GB | 2382769 | 6/2003 |

OTHER PUBLICATIONS

European Search Report for EP 07250887 date of completition of the search Nov. 20, 2007.

* cited by examiner

*Primary Examiner* — Gregory L Huson
*Assistant Examiner* — Karen Younkins
(74) *Attorney, Agent, or Firm* — Martin Fleit; Paul D. Bianco; Fleit Gibbons Gutman Bongini & Bianco PL

(57) ABSTRACT

An upward discharge waste device for a shower tray, comprises a hollow housing having a waste water inlet, a waste water outlet and a flow-channel for waste water between the waste water inlet and the waste water outlet; and a mounting element for mounting the waste device over a waste outlet of the shower tray. The flow-channel has a non-uniform transverse cross-sectional shape along the longitudinal extent from the waste water inlet and towards the waste water outlet, but has a uniform or substantially uniform transverse cross-sectional area along the longitudinal extent. A shower tray having the waste device is also provided.

14 Claims, 8 Drawing Sheets

UPWARD DISCHARGE WASTE DEVICE FOR A SHOWER TRAY

The present invention relates to an upward discharge waste device for a shower tray.

BACKGROUND OF THE INVENTION

Upward discharge waste devices are known. For example, an upward discharge waste device is supplied by AKW Medi-Care of Worcester, United Kingdom. This type of waste is fastened to a wall of a sump on a shower tray and provides means whereby waste water entering the sump may be pumped out generally in an initially vertically upwards direction. The waste device comprises a hollow housing of substantially uniform cross-sectional shape, generally being cuboid. To allow the pumped suction to remove as much waste water from the sump as possible, the housing is closely spaced from the bottom of the sump. Waste water flowing into the sump must therefore enter the hollow housing from under its lower edge. As the water level in the housing rises, the waste water outlet is reached and the waste water is drawn through the waste water outlet by a pump connected to the drain.

Another example of an upward discharge device is also known from Impey UK Ltd, where the discharge channel connected to the pump is a tube located in the top of a waste sump cover, and the waste liquid is drawn directly from the sump through the pipe by the pump. The pipe end is similarly closely spaced from the bottom of the sump to remove as much waste water as possible. Again, however, the discharge housing within the sump is of uniform cross-sectional shape, being cylindrical.

These types of known arrangements are intended to provide a means of removing waste water from a shower drain sump in installations where it is not possible to create piped arrangements below the level of the shower base—such as multi-occupancy 'high-rise' buildings where floors are reinforced concrete and may not be breached for various reasons. Often in such installations, a communal service duct runs vertically through the bathroom linking one floor to another and providing a common means to route power and other services, including waste water disposal, too and from the building. In such installations, the shower waste must be directed into the waste pipe from a position above the floor level in the accommodation.

However, since waste water may only flow into the sump at a relatively low and erratic flow rate, dictated by movements of the person showering, the placement of their feet obstructing water drainage to the waste sump, the effects of gravity, and the slope of the shower flooring, for example, it is quickly drawn out through the relatively small effective diameter of the waste water outlet by the uniform action of the pump. Consequently, a substantial amount of air is also entrained, causing substantial and undesirable noise.

The present invention seeks to overcome this problem.

SUMMARY OF THE INVENTION

According to a first aspect of the invention, there is provided an upward discharge waste device for a shower tray, the waste device comprising a hollow housing having a waste water inlet, a waste water outlet and a waste water flow-channel between the waste water inlet and the waste water outlet, wherein the flow-channel has a non-uniform transverse cross-sectional shape along a longitudinal extent from the waste water inlet and towards the waste water outlet, and a uniform or substantially uniform transverse cross-sectional area along the said longitudinal extent.

According to a second aspect of the invention, there is provided a shower tray comprising: a tray portion having an upper surface on which a user is supportable; a sump having a waste water inlet through which waste water from the upper surface of the tray portion flows, a bottom surface which is spaced from the upper surface of the tray portion, and a waste water outlet for connection to a drain and spaced above the bottom surface of the sump; and an upward discharge waste device in fluid communication with the waste water outlet of the sump, the upward discharge waste device comprising a hollow housing having a waste water inlet, a waste water outlet and a waste water flow-channel between the waste water inlet and the waste water outlet, wherein the flow-channel has a non-uniform transverse cross-sectional shape along a longitudinal extent from the waste water inlet and towards the waste water outlet, and a uniform or substantially uniform transverse cross-sectional area along the said longitudinal extent.

The present invention will now be more particularly described, by way of example only, with reference to the accompanying drawings.

DESCRIPTION OF THE PREFERRED EMBODIMENTS

Figure 3:
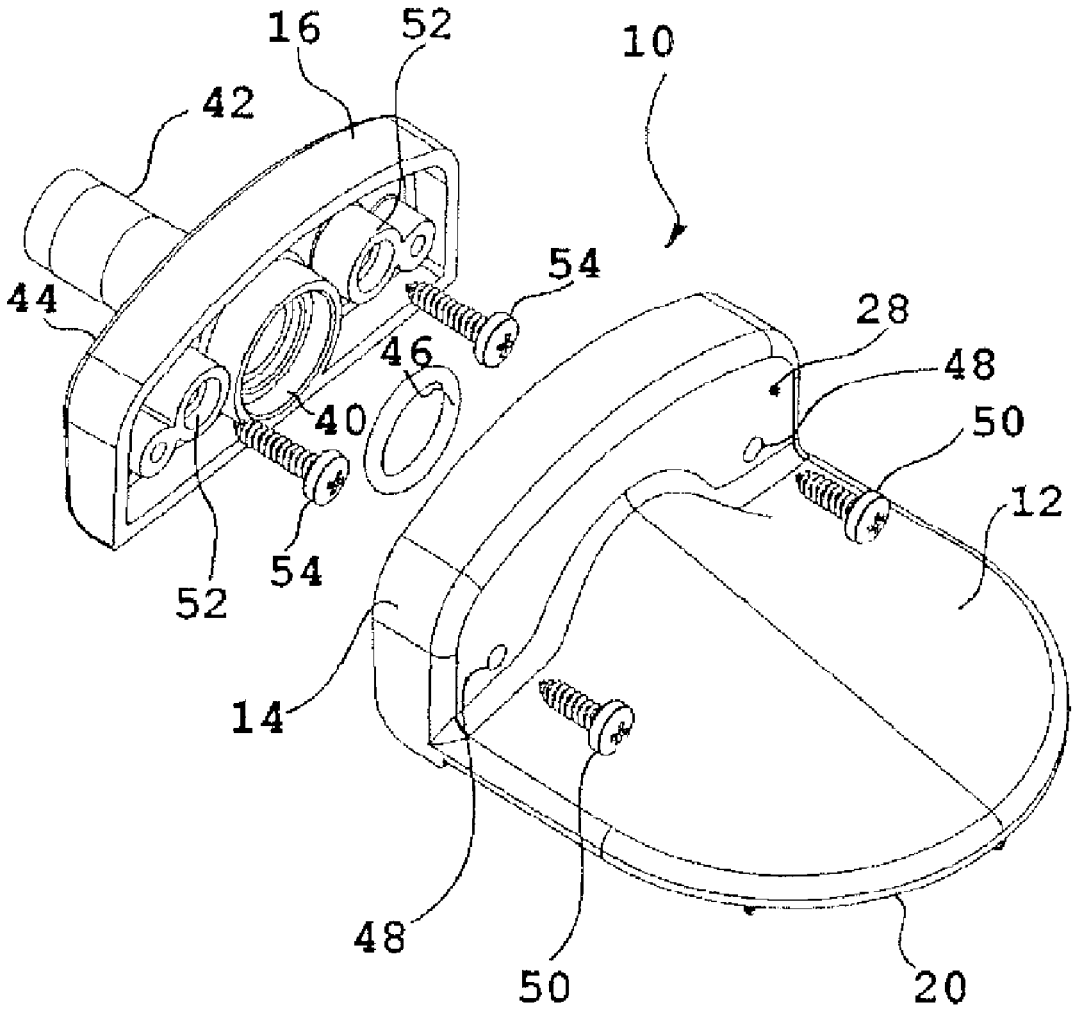
FIG. 3 is an exploded perspective view of the upward discharge waste device, showing a housing and an adaptor.
Figure 6:
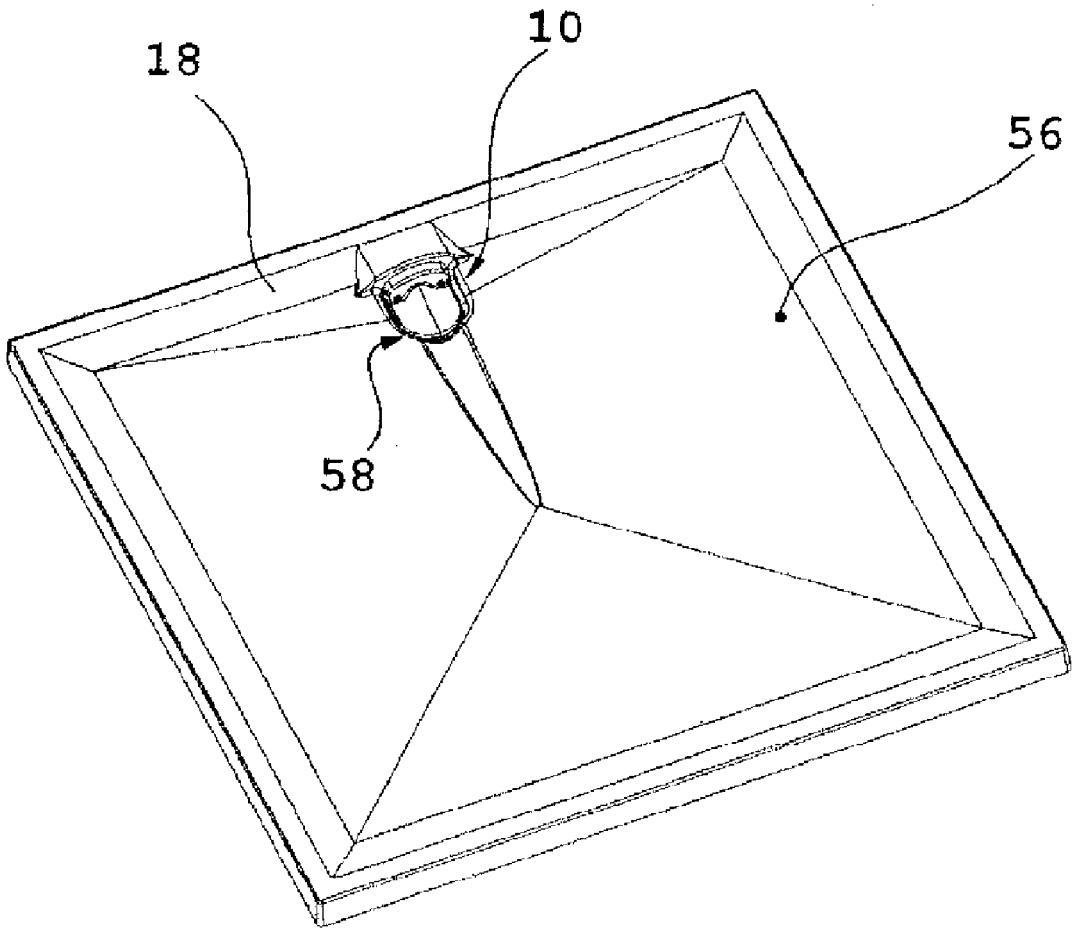
FIG. 6 is a perspective view of a shower tray, in accordance with the second aspect of the invention, having the upward discharge waste device.

Referring firstly to FIGS. 1 to 5*e*, there is shown therein a typically plastics moulded, upward discharge waste device 10 which comprises a hollow 'duck-bill' shaped housing 12 integrally formed with a mounting element 14 at one end thereof, and an adaptor 16, best shown in FIG. 3, for interfacing the waste device 10 with a shower tray 18 (see FIG. 6).

Figure 1:
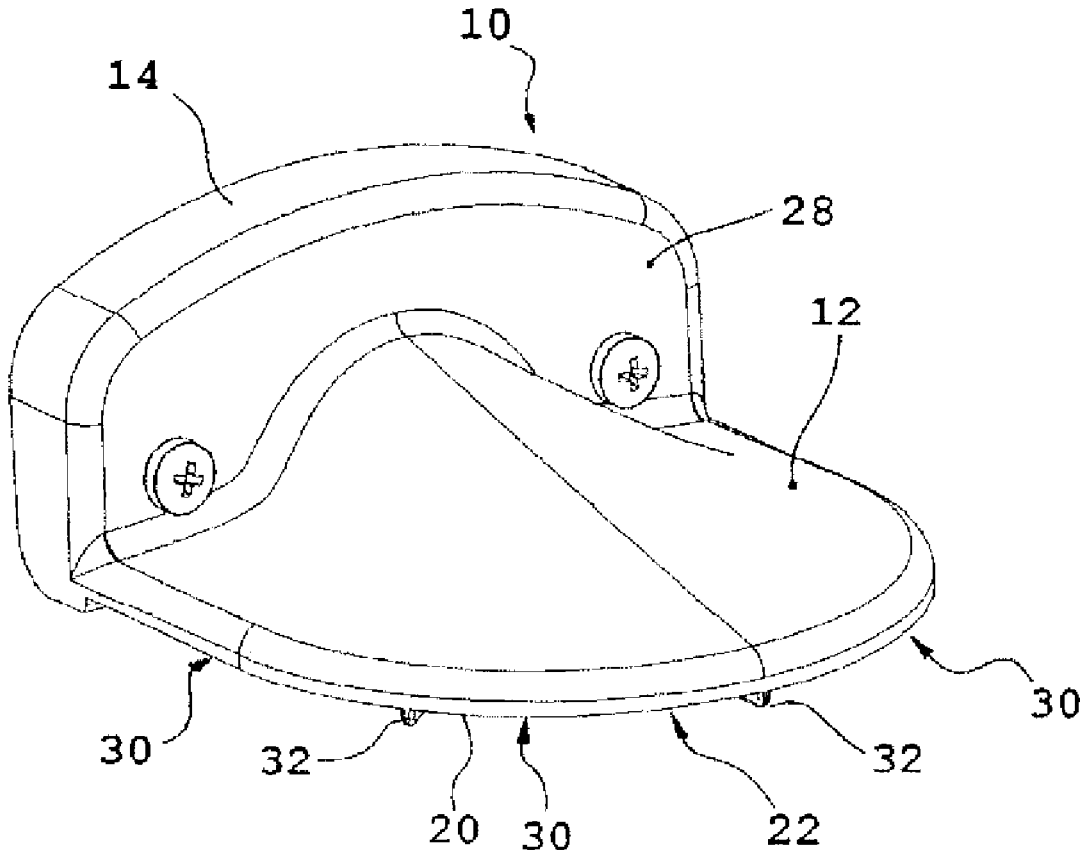
FIG. 1 is a perspective view from the front of one embodiment of an upward discharge waste device, in accordance with the first aspect of the invention.
Figure 2:
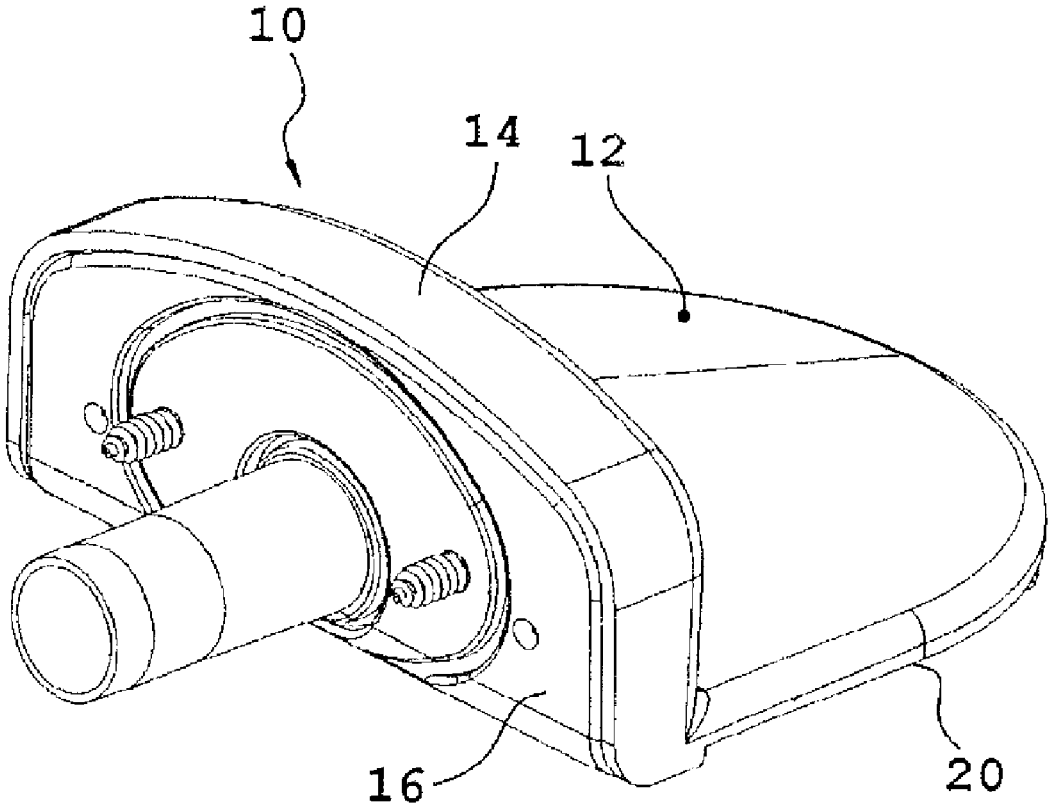
FIG. 2 is a perspective view of the upward discharge waste device, from behind.
Figure 4:
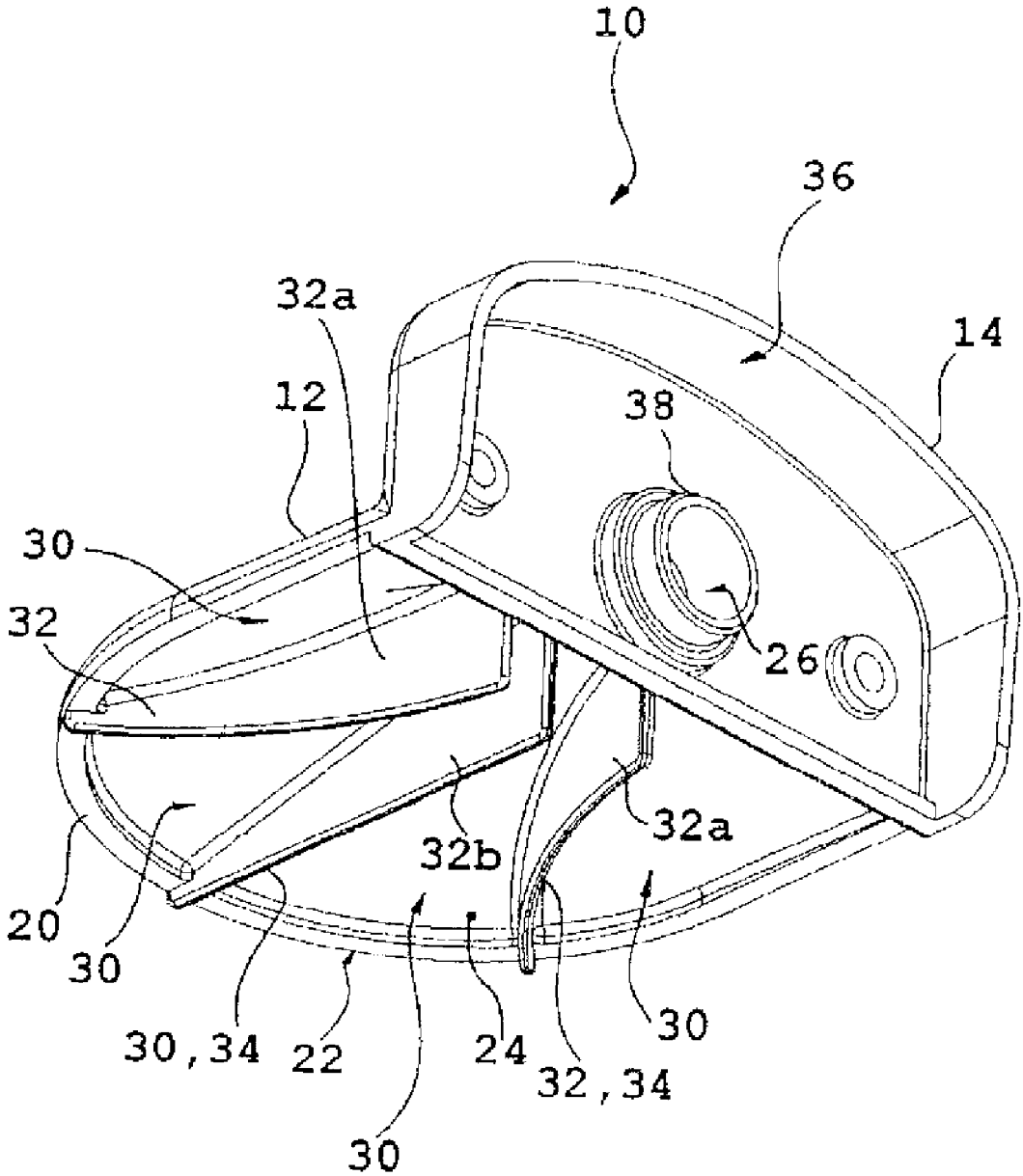
FIG. 4 is a perspective view from below of the housing of the upward discharge waste device.
Figures 5A, 5B, 5C, 5D, 5E:
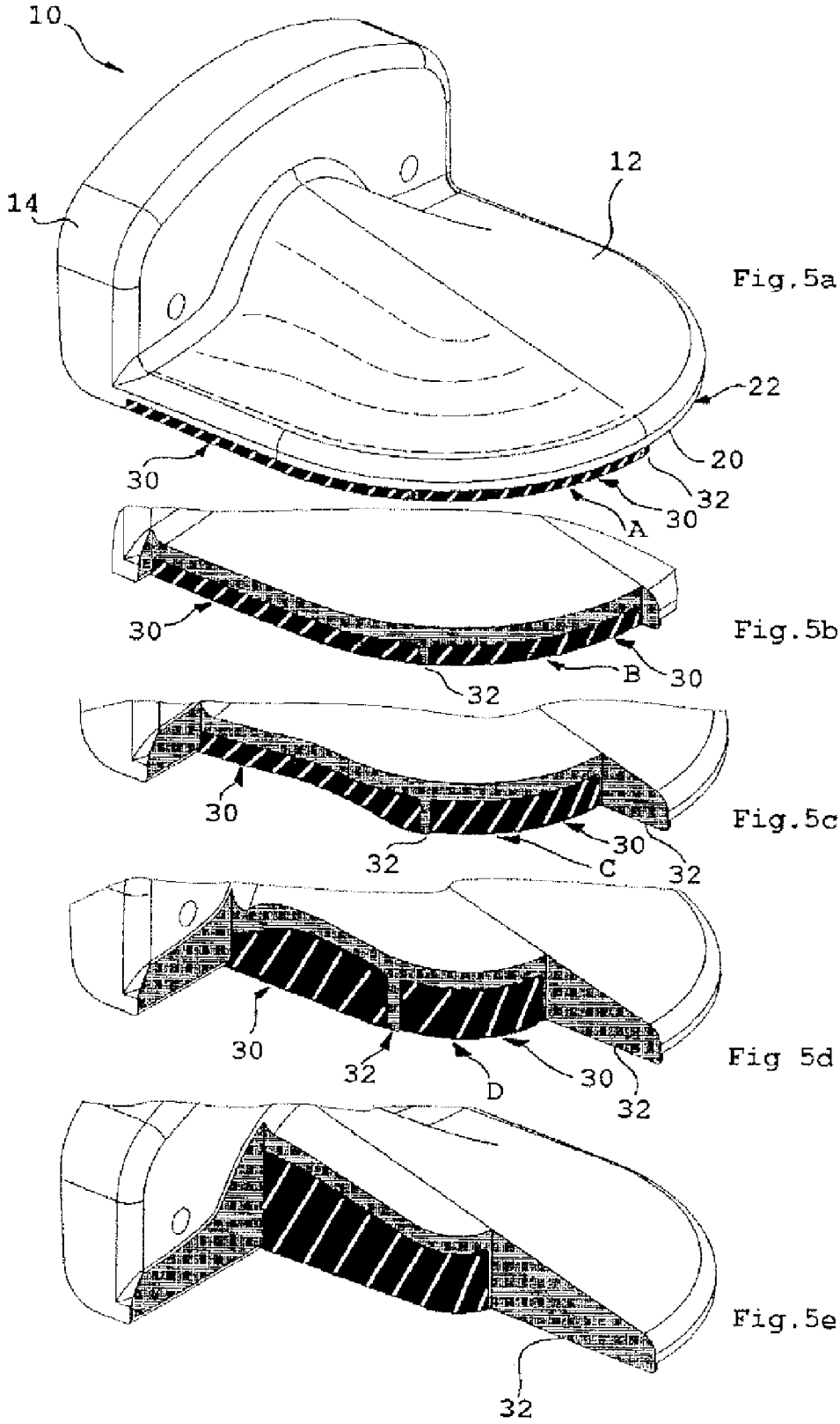
FIGS. 5*a* to 5*e* show the cross-sectional shape of a flow-channel at various positions along its longitudinal extent.

With reference to FIGS. 1 and 4, the hollow housing 12 has an external slightly depending perimeter edge 20 which in part defines a waste water inlet 22 of the waste device 10, and an interior surface 24 which smoothly curves upwardly from the perimeter edge 20 to a position above a waste water outlet 26 formed in a rear wall 28 of the housing 12. The gradient of the interior surface 24 at or adjacent to the perimeter edge 20 is relatively shallow, and the gradient of the interior surface 24 at or adjacent to the rear wall 28 of the housing 12 is relatively steep, and is greater than the gradient at or adjacent to the perimeter edge 20.

A plurality of flow-channels 30 are formed in the hollow housing 12. Each flow-channel 30, as can be seen in FIG. 4, extends from the waste water inlet 22 to a position which is adjacent to the waste water outlet 26, and along the interior surface 24 of the housing 12. One or more baffles 32 are used to define each flow-channel 30. In the present embodiment, three baffles 32 are provided which in part define four flow-channels 30. However, less than or more than three baffles can be provided, depending on necessity or the desire to vary the flow and noise generating characteristics of the device The baffles 32 project below the perimeter edge 20 of the housing 12 to in use act as supports and spacers for the hollow housing 12, and lowermost longitudinal edges 34 of the baffles 32 are coplanar. Due to the sloping interior surface 24 of the housing 12, each baffle 32 has a non-uniform transverse cross-sectional area along its longitudinal extent, as can be appreciated from FIG. 4.

Two of the three baffles 32*a* have arcuate longitudinal extents and are positioned either side of a rectilinear central baffle 32*b*. The flow-channels 30 are thus funnel or substantially funnel shaped.

Referring to FIGS. 4 and 5*a* to 5*e*, due to the sloping duck-bill shape of the housing 12 and the positioning of the baffles 32, although the flow-channels 30 have a non-uniform transverse cross-sectional shape along the longitudinal extent from the waste water inlet 22 and towards the waste water outlet 26, as can be understood when following the sectional views shown in FIGS. 5*a* to 5*e*, the transverse cross-sectional area along the longitudinal extent is uniform or substantially uniform. This allows the transverse cross-sectional area at the inlet to the hollow housing 12 below the perimeter edge 20, indicated by reference A in FIG. 5*a*, to be the same or substantially the same as the transverse cross-sectional area partway along the flow-channel 30, indicated by reference B in FIG. 5*b*, which in turn is the same or substantially the same as the transverse cross-sectional areas further along the flow-channels 30, indicated by references C and D in FIGS. 5*c* and 5*d*, respectively. Following that, the flow-channels 30 end adjacent to the waste water outlet 26, so that liquid flowing along the flow-channels 30 converges at or adjacent to the waste water outlet 26.

The mounting element 14 and adaptor 16, best shown in FIG. 3, are similar to the known prior art, and thus will not be described in any great detail. In brief, the mounting element 14 defines a recess 36 for receiving the adaptor 16. The rear wall 28 of the hollow housing 12 forms one of the walls of the mounting element 14, so that the mounting element 14 and the hollow housing 12 are integrally formed, typically as a one-piece plastics moulding. The adaptor 16 is dimensioned to complementarily fit the recess 36 of the mounting element 14. A waste outlet portion 38 extends from the waste water outlet 26 of the hollow housing 12 to be received for fluid communication in a waste opening 40 formed in the adaptor 16. A waste outlet pipe 42 extends from a rear side 44 of the adaptor 16 for connection to a pump and from there to a drain. The waste opening 40 and the waste outlet pipe 42 are in fluid communication. An elastomeric or rubber, for example, O-ring 46 is utilised between the waste opening 40 of the adaptor 16 and the waste outlet portion 38 of the mounting element 14 to prevent leakage.

Screw-ports 48 are provided in the mounting element 14 and the adaptor 16 to permit releasable engagement of the hollow housing 12 with the adaptor 16 via screw-threaded fasteners 50. The adaptor 16 also includes separate screw-ports 52 for engaging the adaptor 16 with a shower tray 18 via further screw-threaded fasteners 54.

Figure 7:
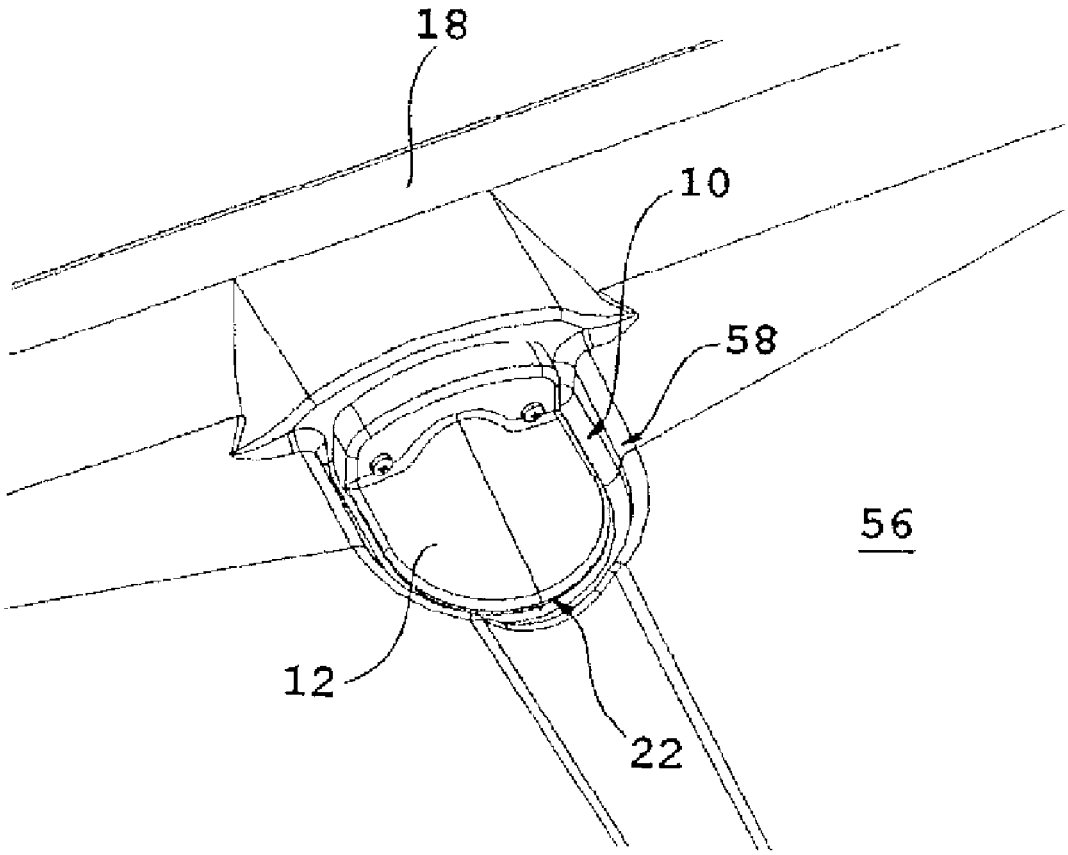
FIG. 7 is an enlarged view of the shower tray and upward discharge waste device.
Figure 8:
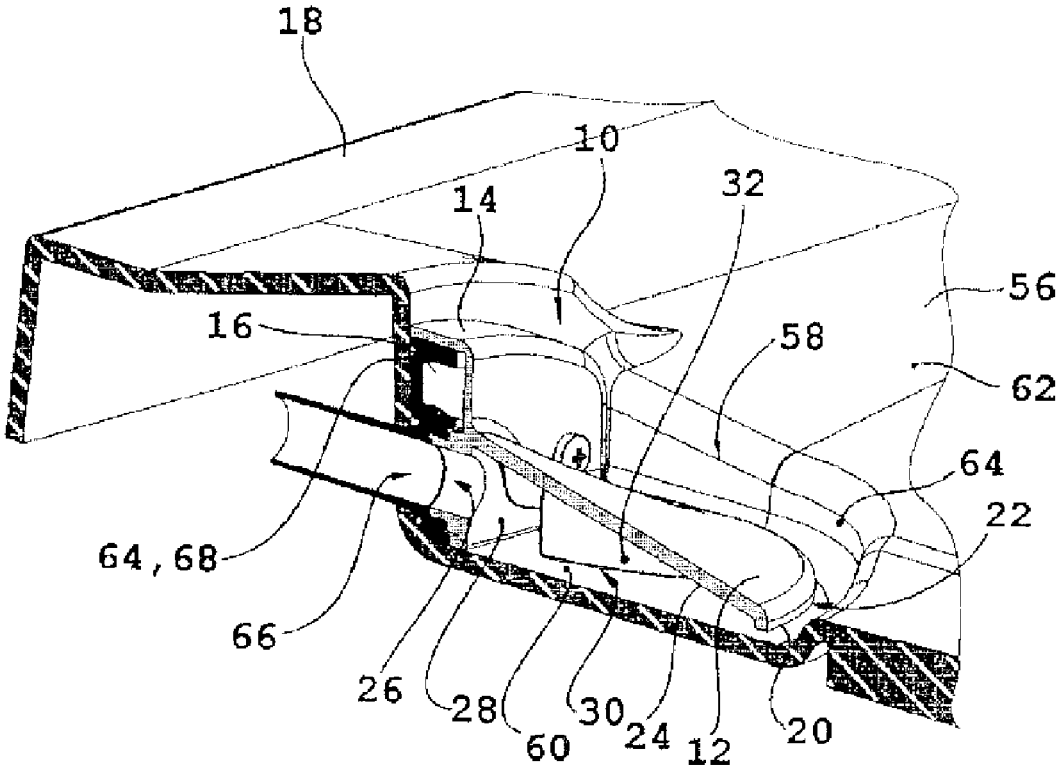
FIG. 8 is a scrap cross-sectional view of the shower tray, taken in a front-to-back direction of the upward discharge waste.

Referring to FIGS. 6 to 7, there is shown the shower tray 18 with the upward discharge waste device 10 installed. The shower tray 18 comprises a tray portion 56 on which a user stands, and a sump 58 formed typically towards one edge of the tray portion 56. The tray portion 56 is formed with a fall to direct waste water to the sump 58. The sump 58 typically includes a removable cover (not shown), and has an interior bottom surface 60 which is spaced from an upper surface 62 of the tray portion 56, and a wall 64 which surrounds and extends upwardly from the bottom surface 60. A waste outlet 66 of the shower tray 18 is formed in a rear wall 68 of the sump 58, in spaced relationship with the bottom surface 60.

The adaptor 16 of the upward discharge waste device 10 is typically permanently, fixed to the rear wall 68 of the sump 58 via the screw-threaded fasteners 54 extending through the screw-ports 52 of the adaptor 16. The waste outlet pipe 42 of the adaptor 16 thus extends through the waste outlet 66 of the shower tray 18, and can be connected to a pump-fed drain. Sealant is used to watertightly seal the adaptor 16 to the sump 58.

The mounting element 14 is then engaged, via the screw-threaded fasteners 50, to the adaptor 16. In this condition, the projecting baffles 32 bear against the bottom surface 60 of the sump 58 to slightly space the perimeter edge 20 of the hollow housing 12 from the bottom surface 60. The waste water inlet 22 into the housing 12 is thus defined by the perimeter edge 20 of the housing 12 and the bottom surface 60 of the sump 58.

In use, waste water runs from the tray portion 56 and enters the sump 58. The waste water flows into hollow housing 12, beneath the perimeter edge 20, and is directed along the flow-channels 30 towards the waste water outlet 26. Since the depth of each flow-channel 30 increases as the width decreases in the direction from the waste water inlet 22 to the waste water outlet 26, the cross-sectional areas of the flow-channels 30 remain constant or substantially constant along their longitudinal extents. This allows a constant or substantially constant volume of water to be fed up to the waste water outlet 26 from the perimeter edge 20 of the hollow housing 12. As a result of this greater entrainment perimeter distance for the suction effect of the pumped waste, no or a much lesser volume of air is entrained, resulting in greatly reduced noise emanating from the waste water outlet 26.

The upward discharge waste device can be easily retro-fitted to existing shower trays already having known upward discharge waste devices. The waste device can thus be provided as a kit of parts, or can be supplied with a shower tray.

The upward discharge waste device is particularly beneficial for shower trays which have no plumbing below tray level. However, this upward discharge waste device can be utilised on other types of shower tray, dependent on necessity.

It will be obvious to those skilled in the art of pumped waste design that the essential nature of the larger perimeter device so described may be beneficially positioned within a shower waste sump and a waste outlet connected at any point on the upper surface to discharge into a pumped waste system of the hollow housing or mounting element subject to suitable changes being made to the shape and location of the baffles, such that the mounting element may be dispensed with or used only to retain the device within the sump and not provide the waste water disposal tube and opening. Such changes will remove the requirements to pass the waste pipe through the wall of the shower tray and into the void behind it.

Additionally, or alternatively, the upward discharge waste device can be provided integrally formed as part of a sump, trap or shower tray, and thus the mounting element can also be dispensed with, in this instance.

The embodiment described above is given by way of example only, and various other modifications will be apparent to persons skilled in the art without departing from the scope of the invention, as defined by the appended claims. For example, it may be possible to provide the hollow housing shaped in a manner whereby the baffles can be dispensed with; and the use of the term 'baffle' is intended to cover any suitable directing or guiding surface or wall.

What is claimed is:

1. An upward discharge waste device for a shower tray, the waste device comprising a hollow housing having a waste water inlet, a waste water outlet and a waste water flow-channel between the waste water inlet and the waste water outlet, a perimeter edge of an interior surface of the housing defining in part the waste water inlet, the perimeter edge curving upwardly to the waste water outlet, wherein the flow-channel between the waste water inlet and the waste water outlet has a non-uniform transverse cross-sectional shape along a longitudinal extent from the waste water inlet and towards the waste water outlet, and a uniform or substantially uniform transverse cross-sectional area along the said longitudinal extent, the inlet and outlet defining a width therebetween, whereby a depth of the flow-channel increases as the width decreases in the direction from the inlet to the outlet to enable a substantially constant volume of water to be fed to the waste water outlet from the perimeter edge of the housing.

2. An upward discharge waste device as claimed in claim 1, wherein the housing is duck-bill shaped.

3. An upward discharge waste device as claimed in claim 1, wherein the housing curves upwardly from the waste water inlet towards the waste water outlet.

4. An upward discharge waste device as claimed in claim 1, wherein the interior surface of the housing has a first gradient at or adjacent to the waste water inlet, and a second gradient which is steeper than the first gradient at or adjacent to the waste water outlet.

5. An upward discharge waste device as claimed in claim 1, wherein the waste water inlet is or is in part defined by a lower perimeter edge of the housing.

6. An upward discharge waste device as claimed in claim 1, wherein the housing has a plurality of waste water flow-channels.

7. An upward discharge waste device as claimed in claim 1, wherein the housing includes at least one baffle.

8. An upward discharge waste device as claimed in claim 7, wherein the at least one baffle defines at least a part of the flow-channel.

9. An upward discharge waste device as claimed in claim 7, wherein the at least one baffle extends from the waste water inlet to or adjacent to the waste water outlet.

10. An upward discharge waste device as claimed in claim 7, wherein the at least one baffle is arcuate along a longitudinal extent of the baffle.

11. An upward discharge waste device as claimed in claim 7, wherein a transverse cross-sectional area of the at least one baffle is non-uniform along a longitudinal extent of the baffle.

12. An upward discharge waste device as claimed in claim 1, further comprising a shower tray adaptor, and a mounting portion which is removably connectable to the said shower tray adaptor.

13. An upward discharge waste device as claimed in claim 1, in the form of a kit of parts.

14. A shower tray comprising:

a tray portion having an upper surface on which a user is supportable;

a sump having a waste water inlet through which waste water from the upper surface of the tray portion flows, a bottom surface which is spaced from the upper surface of the tray portion, and a waste water outlet for connection to a drain and spaced above the bottom surface of the sump; and the upward discharge waste device of claim 1 in fluid communication with the waste water outlet of the sump.

* * * * *